United States Patent [19]

Tajima

[11] Patent Number: 4,885,438

[45] Date of Patent: Dec. 5, 1989

[54] CONNECTOR SOCKET WITH A SWITCH

[75] Inventor: Kyousuke Tajima, Gunma, Japan

[73] Assignee: Hosiden Electronics Co., Ltd., Osaka, Japan

[21] Appl. No.: 231,814

[22] Filed: Aug. 12, 1988

[30] Foreign Application Priority Data

Aug. 17, 1987 [JP] Japan ..... 62-125380[U]

[51] Int. Cl.[4] ..... H01R 33/96

[52] U.S. Cl. ..... 200/51.09; 200/51.11; 200/303; 200/550

[58] Field of Search ..... 200/51.05–51.07, 200/51.09–51.11, 550, 547, 303

[56] References Cited

U.S. PATENT DOCUMENTS 4,393,283 7/1983 Masuda ..... 200/51.09

4,778,240 10/1988 Komatsu ..... 200/51.09

FOREIGN PATENT DOCUMENTS 1138301 1/1957 France ..... 200/51.10

*Primary Examiner*—Renee S. Luebke

*Attorney, Agent, or Firm*—Pollock, VandeSande and Priddy

[57] ABSTRACT

A slide switch is coupled with a connector socket which is capable of firmly gripping a plug inserted thereinto and in which a resilient tubular metal cover having a slit in its axial direction is fitted in an annular groove cut in a socket body. An actuator formed integrally with and extending from a holder carrying a movable contact piece is disposed in a main positioning groove which extend across and in parallel to the annular groove. The actuator is driven by inserting a plug into the pulling it out of the socket body, by which the connection of the slide switch is changed over.

10 Claims, 8 Drawing Sheets

CONNECTOR SOCKET WITH A SWITCH

BACKGROUND OF THE INVENTION

The present invention relates to a connector socket with a switch for use in various electronic equipment and apparatus.

For higher performance and further miniaturization of electronic equipment and apparatus, similar requirements are now being imposed on electronic parts. One such electronic part is a miniature high-reliability connector with a switch for interconnecting electronic equipment, apparatus and so forth.

Conventionally, a switch which is additionally provided in a connector has an arrangement in which a springlike movable contact piece is moved into or out of contact with a fixed contact by the insertion of a plug, as shown in FIG. 15 of U.S. Pat. No. 4,637,669, for example. However, the switch of such an arrangement is not completely reliable since dust or a like foreign substance between the movable contact piece and the fixed contact will directly lead to bad contact therebetween.

Further, it is difficult, with the above switch structure, to increase the number of contacts because there is a limit to the number of movable contacts which may be provided side by side along the rear end portion of an actuator which is moved by the plug. Even if a plurality of switches could be disposed side by side, difficulty would be encountered in timing the actuation of each switch.

SUMMARY OF THE INVENTION

It is therefore an object of the present invention to provide a connector socket with a switch which is highly reliable in operation.

The present invention employs the connector socket of the type that is small in size but firmly engages the plug, suggested in the aforementioned United States patent. The connector socket comprises: a socket body of an insulating material which has an annular groove of a U-shaped cross section cut in the front end face of the socket body, a plurality of contact receiving holes extending through the socket body from the front end face encircled by the annular groove to the rear end face of the socket body, and a main positioning U-shaped groove cut in the inner wall of the annular groove and extending in a direction in which the plug is inserted; female contacts received in the contact receiving holes of the socket body; and a tubular metal cover fitted in the annular groove, and the tubular metal cover being made from elastic sheet metal and having a gap extending in the axial direction of the tubular body so that the cover is elastically deformable diametrically thereof. The connector socket is combined with a slide switch which has an actuator projecting out of a switch box and a spring provided in the box, for biasing the actuator in the direction of projection thereof to hold it at one switch position, the actuator being moved to the other switch position by being pressed into the box against the biasing force of the spring, and engaging means whereby the socket body constituting the connector socket and the box of the slide switch, with the actuator of the latter inserted in the main positioning groove cut in the socket body. Thus the connector socket with a switch of the present invention is provided.

With the above structure, the plug inserted into the connector socket is engaged with the tubular metal cover of the connector socket and firmly retained thereto. Accordingly, even if the reaction from the slide switch which is actuated by the insertion of the plug is large, the slide switch can be held in its actuated state. Moreover, it is possible to obtain a connector socket with a switch which is highly stable and reliable in switching operation through the self-cleaning action of the slide switch.

DESCRIPTION OF THE PREFERRED EMBODIMENTS

Figure 1:
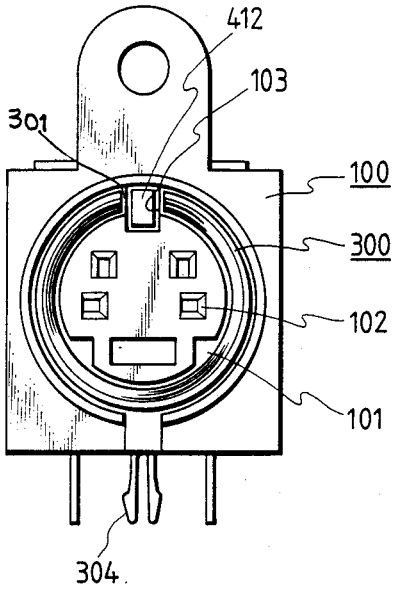
FIG. 1 is a front view illustrating a first embodiment of the present invention.
Figure 2:
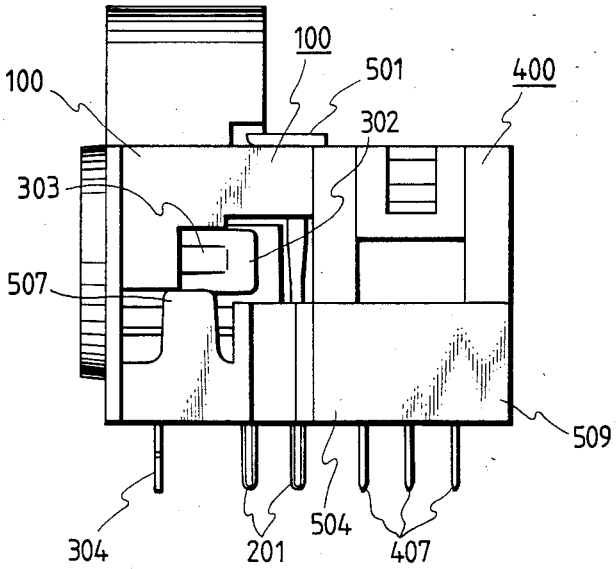
FIG. 2 is its side view.

FIGS. 1 through 8 illustrates a first embodiment of the present invention. Reference numeral 100 indicates a socket body of an insulating material which forms the connector socket section, 200 designates female contacts inserted in contact receiving holes made in the socket body 100, 300 designates a tubular metal cover, 400 designates a slide switch section, and 500 engaging means.

The socket body 100 has an annular groove 101 cut in its front end face and open thereto, a plurality of contact receiving holes 102 bored through the socket body 100, extending from its front end face surrounded by the annular groove 101 to the rear end face of the body 100, and a main positioning groove 103 cut in the inner wall of the annular groove 101.

Figure 3:
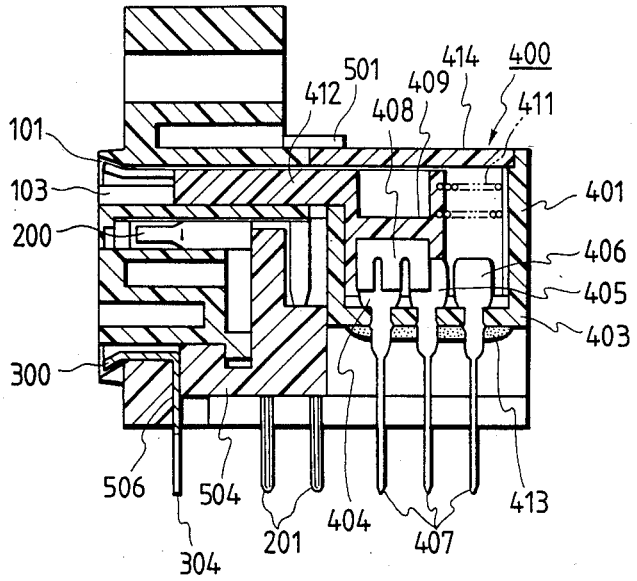
FIG. 3 is its sectional view.
Figure 4:
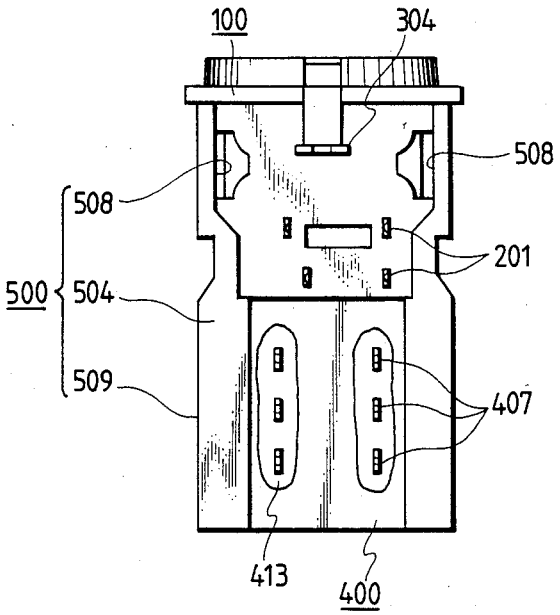
FIG. 4 is its bottom view.
Figure 10:
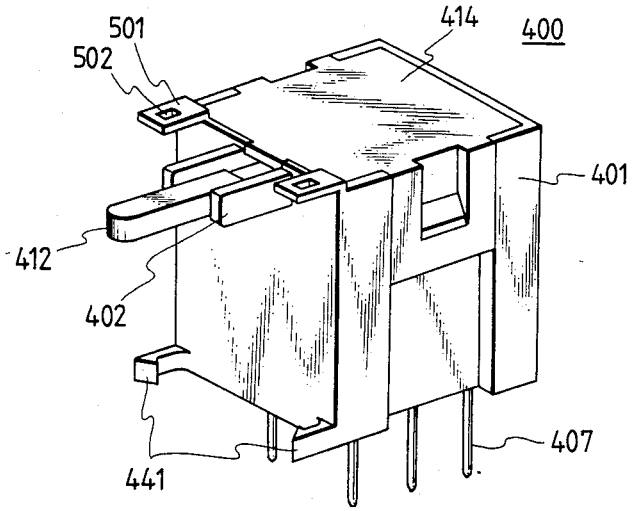
FIG. 10 is a perspective view of a switch section which is coupled with the socket in the case where the base portion of FIG. 9 is employed.
Figure 11:
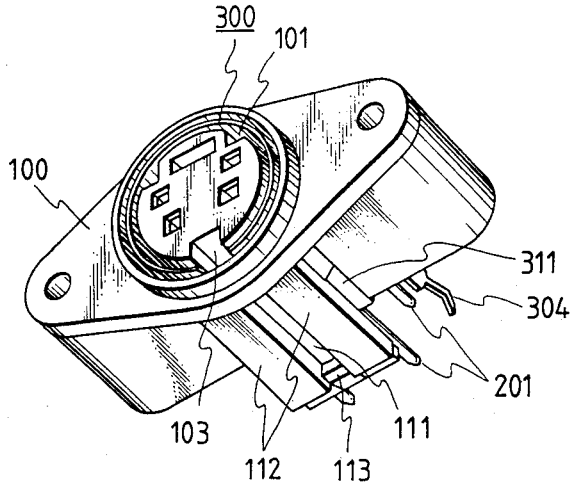
FIG. 11 is a perspective view of a socket body of a third embodiment of the present invention.

The tubular metal cover 300, which is substantially the same as that shown in FIG. 10 of the aforementioned United States patent, is fitted into the annular groove 101. The tubular metal cover 300 is formed by pressing, with its front marginal portion spread wide open. Such a fanning-out open front end portion guides a tubular metal cover of a plug, such as shown in FIG. 3 of the aforementioned United States patent, into engagement with the inner surface of the tubular metal cover 300 and imparts a high degree of elasticity to the cover 300.

The tubular metal cover 300 has at its rear end a pair of projecting pieces 302, each having a lug 303 obliquely standing up therefrom. The lugs 303 engage the rear end of the socket body 100 to prevent the tubular metal cover 300 from disengagement from the socket body 100, ensuring holding the cover 300 in the annular groove 101. Reference numeral 304 indicates a grounding terminal projecting from the rear end of the tubular metal cover 300 at right angles thereto.

The tubular metal cover 300 is fitted into the annular groove 101, with a gap 301 of the former held in alignment with the main positioning groove 103 of the socket body 100.

The female contacts 200 are inserted into the contact receiving holes 102. In this embodiment the female contacts 200 each have a terminal 201 projecting from their rear end at right angles thereto, and the terminals 201 all project out of the socket body 100 in the same direction.

That is, the terminals 201 are led out of the socket body 100 in the same direction as the grounding terminal 304, which is led out of the tubular metal cover 300 at right angles to its axis.

As the female contacts 200, two kinds of contacts are used which differ in the either the lengths of their axially extending bodies or the lengths of their laterally extending terminals 201 so as to prevent the terminals 201 from contacting each other.

Figure 5:
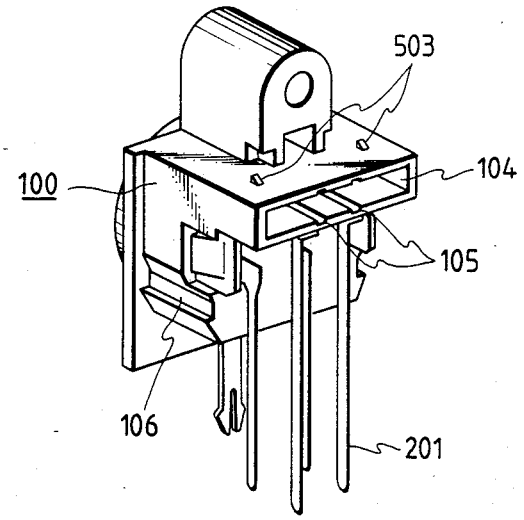
FIG. 5 is a perspective view, for explaining the construction of a socket body.
Figure 6:
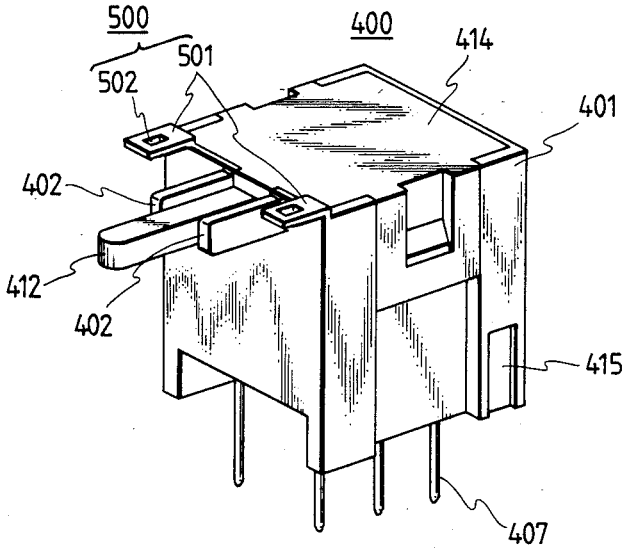
FIG. 6 is a perspective view showing, by way of example, the external appearance of a slide switch section.

The slide switch section 400 is mounted on the back of the socket body 100, with the female contacts 200 received in the contact receiving holes 102. To allow ease in this mounting, in this embodiment, there is made in the rear end face of the socket body 100 a recess 104 which extends therefrom toward the front end face thereof and has its central portion communicating with the main positioning groove 103, as shown in FIG. 5. On the other hand, the slide switch section 400 has a pair of guide arms 402 on the front end face of a switch box 401 constituting the slide switch section 400 and a pair of engaging pieces 501 projecting from the top face of the box 401 forwardly thereof, as depicted in FIG. 6, the pair of projecting pieces 501 forming part of the engaging means 500.

The engaging pieces 501 each have a hole 502 for engagement with protrusions 503 formed on the top face of the socket body 100, by which the socket body 100 and the slide switch section 400 are coupled together. In this case, the engaging pieces 501 are engaged with the protrusions 503, with the guide arms 402 fitted in guide grooves 105 made in the inner wall of the recess 104, by which the socket body 100 and the slide switch section 400 are provisionally assembled together. In this state the female contacts 200 are prevented by the front end face of the box 401 of the slide switch section 400 from slipping out of position. This allows ease in subsequent handling of the assembly.

The slide switch section 400 has fixed contact pieces 404, 405 and 406 which penetrate through a bottom panel 403 of the box 401 as depicted in FIG. 3. In this embodiment the fixed contact pieces 404, 405 and 406 are provided in two rows, forming two switches. The fixed contact pieces 404, 405 and 406 have terminals 407, which are disposed in alignment with the terminals 201 of the connector socket.

A pair of clip-type movable contact pieces 408 (see FIG. 7) make sliding contact with the fixed contact pieces 404, 405 and 406 while gripping them. The sliding movement of each movable contact piece 408 held by a holder 409 made of an insulator switches between a state in which the center fixed contact piece 405 is connected to the one fixed contact piece 404 and a state in which the center fixed contact piece 405 is connected to the other fixed contact piece 406. The holder 409 is substantially in the form of a rectangular parallelepiped and is urged forward by a spring 411 (see FIG. 3), normally holding the movable contact pieces 408 in contact with the fixed contact pieces 405 and 404.

Figure 7:
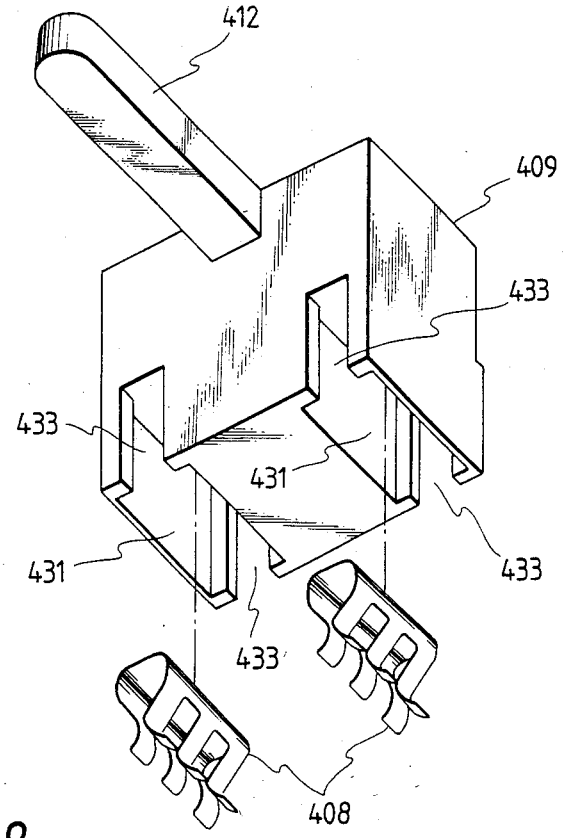
FIG. 7 is a perspective view showing a holder formed as a unitary structure with an actuator and a movable contact piece which is held by the holder.

The holder 409 has formed integrally therewith a rod-like actuator 412 projecting out thereof as shown in FIG. 7, which projects forwardly of the front end face of the box 401. The actuator 412 extends from the front end face of the box 401, for example, at a position between the pair of guide arms 402, as shown in FIG. 6. The actuator 412 is inserted into the main positioning groove 103 of the socket body 100 through the recess 104 so that the front end of the actuator 412 lies in the main positioning groove 103. Incidentally, the portion where the terminals 407 of the fixed contact pieces 404, 405 and 406 are led out of the box 401 are deposited with an adhesive 413 to prevent flux from entering into the box 401 during soldering. Further, the top of the box 401 of the slide switch section 400 is covered with a lid 414.

The actuator 412 and the holder 409 substantially in the form of a rectangular parallelepiped are formed as a unitary structure with each other, as depicted in FIG. 7. The holder 409 has holes 431 made in its bottom, for receiving the movable contact pieces 408, and slits 433 in front and rear walls of the holder 409 cut from the said bottom in communication with the holes 431. The widths of the slits 433 are smaller than the width of the movable contact pieces 408 and greater than the thicknesses of the fixed contact pieces 404, 405 and 406 (FIG. 3). Accordingly, it is possible for the movable contacts 408 received in the holes 431 to slide while gripping the fixed contact pieces 404, 405 and 406.

Figure 8:
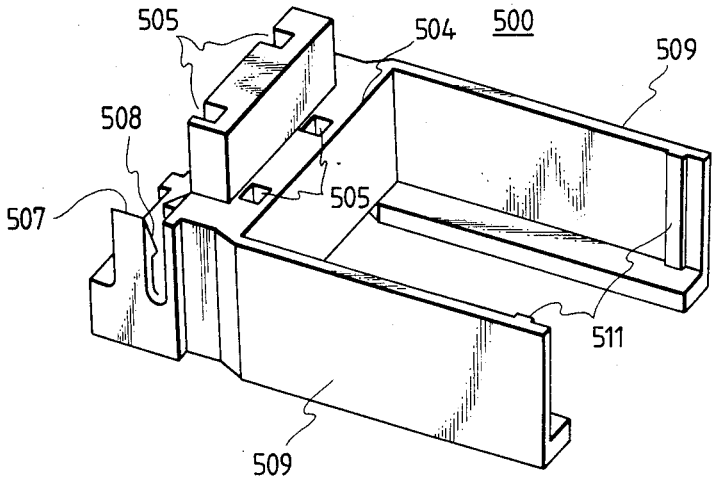
FIG. 8 is a perspective view, for explaining the constructions of coupling means and a base portion for defining the position of a terminal.

A base 504 shown in FIG. 8 forms a part of the means 500 for coupling together the socket body 100 and the slide switch section and at the same time defines the positions of the terminals 202. The base 504 has holes 505 for receiving the terminals 201 led out of the connector socket and a hole 506 (see FIG. 3) for receiving the grounding terminal 304. The base 504 is attached to the assembly of the switch section 400 and the socket body 100 with the terminals 201 and the grounding terminal 304 inserted in the holes 505 and the hole 506 of the base 504, respectively, to thereby fix the terminals 201. In this instance, a pair of protrusions 508 (only one is seen in FIG. 8) formed integrally with a pair of lugs 507 are engaged with a pair of engaging grooves 106 (only one is seen in FIG. 5) cut in the socket body 100.

Further, a pair of ridges 511 formed on the inside of a pair of rearwardly extending receiving arms 509 are engaged with grooves 415 (see FIG. 6) cut in the box 401 of the slide switch section 400, by which the socket body 100 and the slide switch section 400 are assembled into a unitary structure.

In other words, the coupling between the socket body 100 and the slide switch section 400 is maintained by the engagement of the protrusions 503 with the holes 502, the engagement of the lugs 507 with the grooves 106, and the engagement of the ridges 511 with the grooves 415. Since the direction of each engagement is selected to differ from the others, the socket body 100 and the slide switch section 400 are rigidly coupled together.

Figure 9:
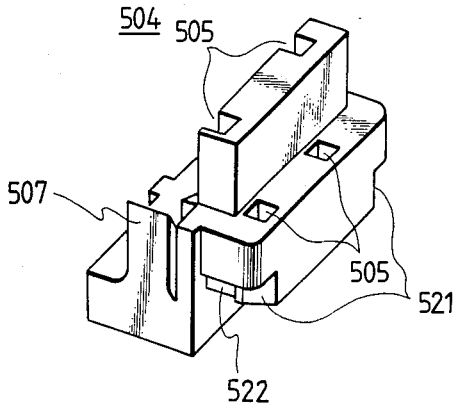
FIG. 9 is a perspective view of a base portion used in a second embodiment of the present invention.

FIGS. 9 and 10 illustrate the base 504 and the slide switch section 400 in accordance with another embodiment of the present invention. The socket body 100 in this embodiment is exactly the same as shown in FIG. 5. According to this embodiment, a connector socket with or without a switch could be obtained depending on whether the base 504 depicted in FIG. 9 is combined with the switch section 400 shown in FIG. 10 or not as required.

The base 504 in FIG. 9 is substantially identical in construction with that depicted in FIG. 8 except that it is not provided with the receiving arms 509 and has recesses 521 formed in the lower end portions at the both corners thereof and engaging projections 522 extending from side walls of the recesses 521.

The switch section 400 in FIG. 10 has about the same construction as that shown in FIG. 6 except that hooks 441, which project in the same direction as the actuator 412, extend from the front end face of the switch box 401 at the lower corners thereof, the free end portions of the hooks 441 being curved inwardly toward each other.

The socket body 100 in FIG. 5 and the base 504 in FIG. 9 are assembled together to form a socket and then the switch section 400 in FIG. 10 is attached to the socket for behind, with the engaging pieces 501 of the switch section 400 engaged with the protrusions 503 of the socket body 100 and the hooks 441 of the switch section 400 with the engaging projections 522 in the recesses 521 of the base 504.

FIGS. 11 to 15 illustrate another embodiment of the present invention, in which the slide switch section 400 is attached to one side of the socket body forming a connector socket.

The socket body 100 has a flat protuberance 112 on the underside thereof and the protuberance 112 has a narrow window 111 formed along the main positioning groove 103. The actuator 412 of the slide switch section 400 is inserted into the main positioning groove 103 through the window 111 as depicted in FIG. 13.

Figure 12:
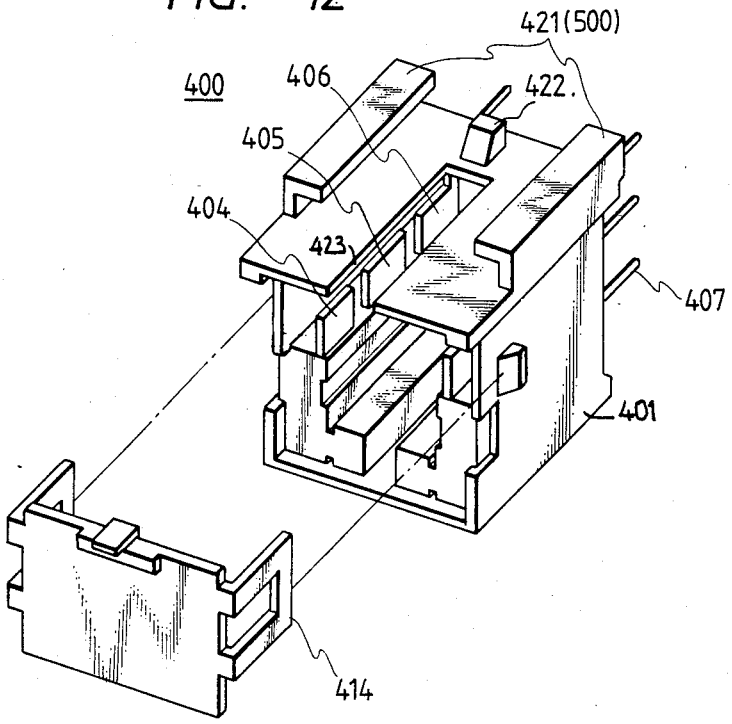
FIG. 12 is a perspective view, for explaining the construction of a slide switch section which is coupled with the socket body depicted together therewith.

The protuberance 112 has grooves 311 formed in its two side faces, and engaging members 421 provided on the box 401 of the slide switch section 400, shown in FIG. 12, are slid into engagement with the grooves 311. As depicted in FIG. 13, a lug 422 of the box 401 is engaged with an engaging portion provided at the rear end of the window 111, preventing the box 401 from coming off the socket body 100. Accordingly, the protuberance 112 and the engaging members 421 constitute the coupling means 500 in this embodiment. The box 401 of the slide switch section 400 has a slot 423 which is in alignment with the window 111 of the socket body 100 when the switch section 400 is assembled with the socket body 100. The actuator 421 formed integrally with the holder 409 which is housed in the box 401 is inserted into the window 111 of the socket body 100 through the slot 423 and disposed in the main positioning groove 103 lengthwise thereof.

Figure 13:
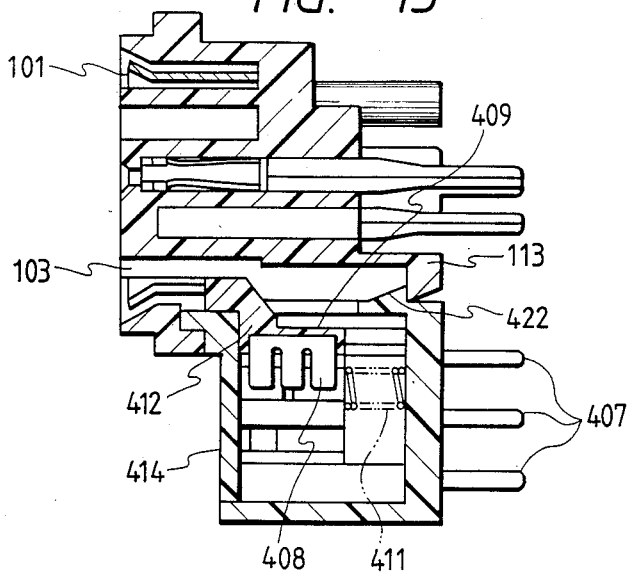
FIG. 13 is a section view of the connector socket with a switch of the third embodiment of the present invention.
Figure 14:
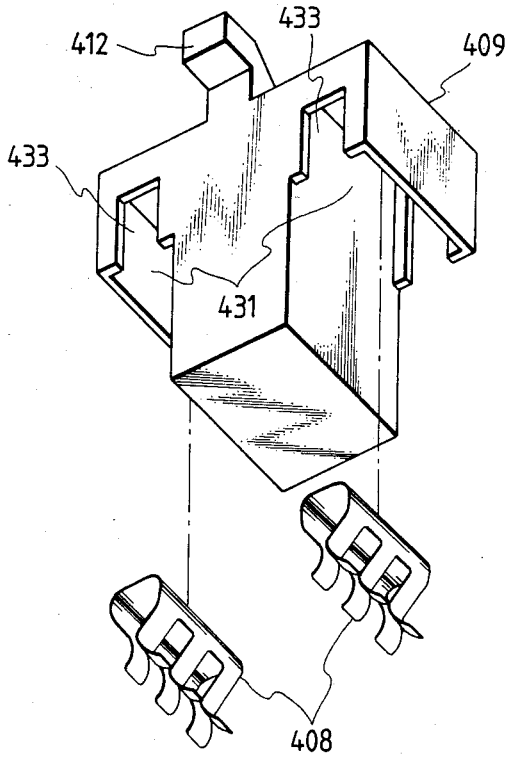
FIG. 14 is a perspective view of a holder for use in the third embodiment.
Figure 15:
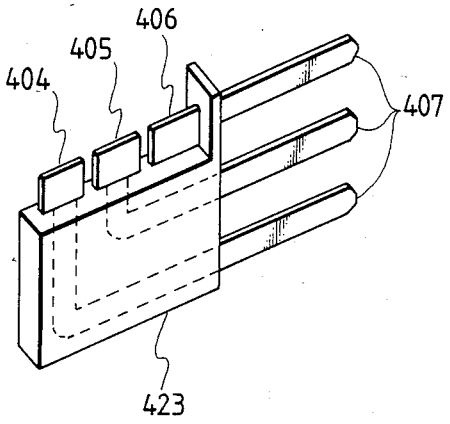
FIG. 15 is a perspective view, for explaining a fixed contact supporting structure of a slide switch used in the third embodiment.

The actuator 421 extends upward from the central portion of the front upper edge of the holder 409 as shown in FIG. 14 to a height such that the actuator 421 enters the above-mentioned window 111 and extends forward therein when the switch section 400 is mounted on the socket body 100, as shown in FIG. 13. The holder 409 has two holes 431 made in its bottom, for receiving the clip-type movable contact pieces 408, and slits 433 communicating with the holes 431, respectively, for passing therethrough the fixed contact pieces 404 to 406.

The slide switch section 400 supports the fixed contacts 404 to 406 arranged in the direction in which a plug (not shown) is inserted into and pulled out from the connector socket. In this embodiment a terminal plate 423 supporting each row of the fixed contact pieces 404, 405 and 406 is made of resin in a form shown in FIG. 15. A pair of such terminal plates 423 are inserted into the box 401 through a pair of slots made in the bottom panel of the box 401 and fixed thereto by welding.

The fixed contact pieces 404 to 406 are held in contact with a pair of clip type movable contact pieces 408. The movable contact pieces 408 are carried by the holder 409, which is pressed by a spring 411 (see FIG. 13) in the direction in which the plug is pulled out of the connector socket. The holder 409 has the actuator 421 formed integrally therewith. The actuator 421 projects out of the box 401 through the slit 423 (see FIG. 12) and is inserted into the main positioning groove 103 of the socket body 100. The front open end of the box 401 is covered with a lid 414 as depicted in FIG. 13.

Thus, also in this embodiment the actuator 412 disposed in the main positioning groove 103 is actuated by inserting the tubular metal cover of the mating plug into the annular groove 101, by which the connection of the contact pieces of the slide switch section is changed over.

Figure 16:
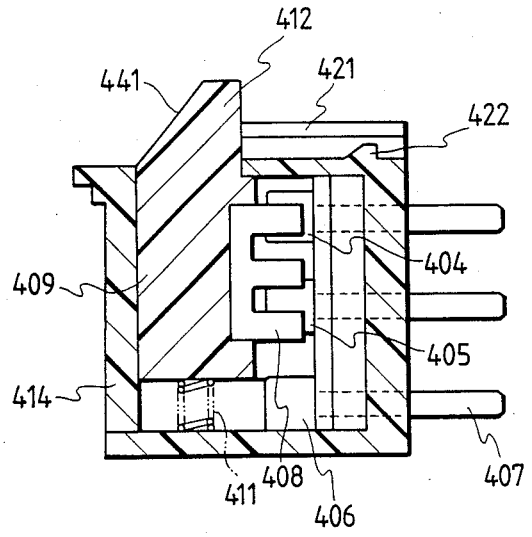
FIG. 16 is a sectional view of a switch section for use in a fourth embodiment of the present invention.
Figure 17:
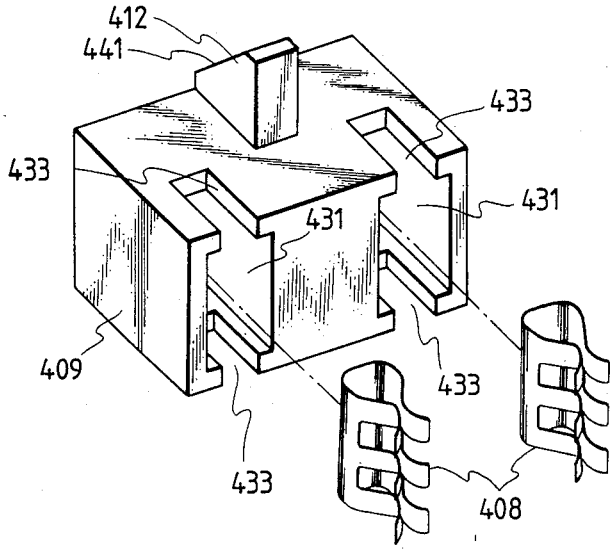
FIG. 17 is a perspective view of a holder for use in the fourth embodiment.

Incidentally, in the embodiment shown in FIGS. 11 to 15 the switch section 400 and the actuator 412 may also be modified as shown in FIGS. 16 and 17. That is to say, the actuator 412 to be disposed in the main positioning groove 103 is a plate-like member, which has a slope 441 at the forward portion thereof so that when the tubular metal of the mating plug is pressed against the slope 441 the actuator 412 is moved in a direction perpendicular to the direction in which the plug is inserted into the connector socket. By this movement the movable contact pieces 408 are slid on the fixed contact pieces 404 to 406 arranged perpendicularly to the direction in which the plug is inserted into and pulled out from the connector socket. The holder 409 has in the back thereof the holes 431 for receiving the movable contact pieces 408 as depicted in FIG. 17.

As described above, according to the present invention, even though the reaction of the spring 411 for biasing the movable contact pieces 408 is large, the slide switch can stably be retained at its switched position without the possibility of the plug coming off the connector socket owing to the strong plug gripping force of the connector socket having the tubular metal cover 300 fitted in the annular groove 101.

Furthermore, the use of the slide switch provides self-cleaning of the contact portions by the sliding movement thereon of the movable contact piece, and hence eliminates the likelihood of bad contact even if dust or other foreign substance adheres to the contact pieces. Since the actuator 412 and the holder 409 are formed as a unitary structure with each other, the operation of the holder 409 by the plug is stable. Therefore, the present invention offers a highly reliable connector socket with a switch.

Moreover, the present invention permits the use of the slide switch, and hence enables the number of switches to be increased as desired. Even if a plurality of switches are provided, it is possible to achieve appropriate timing for switching them.

It will be apparent that many modifications and variations may be effected without departing from the scope of the novel concepts of the present invention.

What is claimed is:

1. A connector socket with a switch, comprising:

(a) a socket body made of an insulating material and having an annular groove extending thereinto from a front end face thereof, a plurality of contact receiving holes made in a columnar portion encircled by the annular groove and extending from the front end face of the socket body therethrough in a direction in which a plug is to be inserted, a main positioning groove cut in the socket body across the annular groove and extending from the front end face of the socket body thereinto in the direction the plug is to be inserted, and an opening made in a face other than the front end face of the socket body and communicating with the main positioning groove;

(b) female contacts received in the contact receiving holes of the socket body;

(c) a resilient tubular metal cover formed by rolling up sheet metal having two opposed sides which are spaced apart from each other, said tubular metal cover being inserted into said annular groove of the socket body;

(d) a slide switch section including a plurality of fixed contact pieces arranged in at least one line, a movable contact piece for sliding contact with the fixed contact pieces, a holder holding the movable contact piece, a spring for biasing the holder in one direction, a switch box housing said fixed contact pieces, said movable contact piece, said holder and said spring, and an actuator formed integrally with the holder and extending out of the switch box through a hole in said switch box and into the main positioning groove through the opening of the socket body so that the actuator is driven by a plug which is inserted into the socket body; and (e) means for fixedly coupling the slide switch section and the socket body together.

2. The connector socket of claim 1, wherein the slide switch section is mounted on the rear of the socket body.

3. The connector socket of claim 2, wherein terminals of the female contacts are led out of one side of the socket body in a direction at right angles to the direction in which the plug is to be inserted into the socket body, a base having slits for defining the positions of the terminals of the female contacts is attached to the said one side of the socket body, and the terminals of the female contacts project out of the socket body through the slits.

4. The connector socket of claim 3, wherein the base has two arms extending along lower side margins of the switch box, for fixedly receiving said switch box.

5. The connector socket of claim 3 or 4, wherein the coupling means includes first engaging means for coupling the base to the socket body in the direction at right angles to the direction of insertion of the plug and second engaging means for coupling the switch box to the socket body in a direction parallel to the direction of insertion of the plug.

6. The connector socket of claim 5, wherein the coupling means includes third engaging means for coupling the slide switch section to the base in the direction parallel to the direction of insertion of the plug.

7. The connector socket of claim 1, wherein the slide switch section is mounted on one side of the socket body.

8. The connector socket of claim 7, wherein the fixed contact pieces are arranged in the direction of insertion of the plug and terminals of the fixed contact pieces are led out of the rear end face of the switch box parallel to the front end face of the socket body.

9. The connector socket of claim 7, wherein the fixed contact pieces are arranged on the rear wall of the switch box parallel to the front end face of the socket body at right angles to the direction of insertion of the plug, and the free end portion of the actuator lying in the main positioning groove has a slope.

10. The connector socket of claim 1, 2, 3, 7, 8 or 9, wherein the holder is substantially in the form of a rectangular parallelepiped having a face which has at least one hole therein for receiving the movable contact piece.

* * * * *